US006814612B1

(12) United States Patent
Hu et al.

(10) Patent No.: US 6,814,612 B1
(45) Date of Patent: Nov. 9, 2004

(54) SHIELDED ELECTRICAL CONNECTOR

(75) Inventors: Jinkui Hu, Kunsan (CN); Guohua Zhang, Kunsan (CN); Lanyi Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/631,998

(22) Filed: Jul. 30, 2003

(30) Foreign Application Priority Data

May 16, 2003 (TW) ..... 92209057 U

(51) Int. Cl.[7] ..... H01R 13/60
(52) U.S. Cl. ..... 439/541.5; 439/607
(58) Field of Search ..... 439/541.5, 607, 439/701, 609, 608, 540

(56) References Cited

U.S. PATENT DOCUMENTS 5,797,770 A * 8/1998 Davis et al. ..... 439/607
6,165,015 A * 12/2000 Wu et al. ..... 439/607
6,200,161 B1 * 3/2001 McClinton et al. ..... 439/541.5
6,280,209 B1 8/2001 Bassler et al.
6,315,608 B1 11/2001 Lopata et al.
6,447,311 B1 9/2002 Hu et al.
6,482,037 B1 11/2002 Zhu et al.

* cited by examiner

*Primary Examiner*—Alex Gilman
(74) *Attorney, Agent, or Firm*—Wei Te Chung

(57) ABSTRACT

An electrical connector or (1) includes an insulative housing, a terminal subassembly, an inner shell (60), an outer shell (71), a rear shell (72) and a pair of grounding tabs (50). The insulative housing (12) includes a mating portion (126) and a supporting portion (120). A pair of channels (127) are defined in the mating portion, The inner shell encloses the mating portion and the outer shell encloses both the insulative housing and the inner shell. A pair of grounding legs (63) extend oppositely from the inner shell, each having a projection protruded therefrom, The grounding legs are received in corresponding channels of the housing, Each grounding tab (50) includes a solder tail (54), a contacting portion (52) and intermediate portion (51) extending therebetween. The contacting portion is received in the corresponding channels and electrically connects to the grounding leg of the inner shell.

16 Claims, 10 Drawing Sheets

SHIELDED ELECTRICAL CONNECTOR

BACKGROUND OF THE INVENTION

1. Field of the Invention

The present invention generally relates to an electrical connector, and particularly to an electrical connector for high-speed data transmission application connector.

2. Description of Prior Arts

With the development of communication and computer technology, electrical connectors for high-speed data transmission are widely used in electronic systems. U.S. Pat. Nos. 6,280,209 and 6,315,608 disclose such electrical connector for high-speed data transmission.

The connector disclosed in the above-mentioned patent comprises an insulative housing having a base portion and a mating portion, a plurality of conductive terminals retained in the housing, an inner shell enclosing the mating portion of the housing for electromagnetic interference protection, and an outer metal shell enclosing both the housing and the inner shell for further electromagnetic interference protection. The outer shell electrically connects to the grounding circuits of a printed circuit board, on which the connector is mounted. The inner shell has foot portion for mounting to the print circuit board to provide a connection to a ground on the circuit board. Obviously, when a high profile connector having a mating portion located relatively far from the printed circuit board is desired, it is very difficult to connect the above-mention inner shell to the printed circuit board on the above-mentioned way.

Hence, it is desirable to have an improved connector to overcome the above-mentioned disadvantages of the prior art.

BRIEF SUMMARY OF THE INVENTION

Accordingly, it is an object of the present invention to provide an electrical connector which can establish a reliable electrical connection between an inner shell thereof and a printed circuit board.

An electrical connector in accordance with the present invention comprises an insulative housing, a terminal subassembly, an inner shell, an outer shell, a rear shell and a pair of grounding tabs. The insulative housing includes a mating portion and a supporting portion. A pair of channels are defined in the mating portion. The inner shell encloses the mating portion and the outer shell encloses both the insulative housing and the inner shell. A pair of grounding legs extend oppositely from the inner shell, each having a projection protruded therefrom. The grounding legs are received in corresponding channels of the housing. Each grounding tab includes a solder tail, a contacting portion and a intermediate portion extending therebetween. The contacting portion is received in the corresponding channels and electrically connects to the grounding leg of the inner shell.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
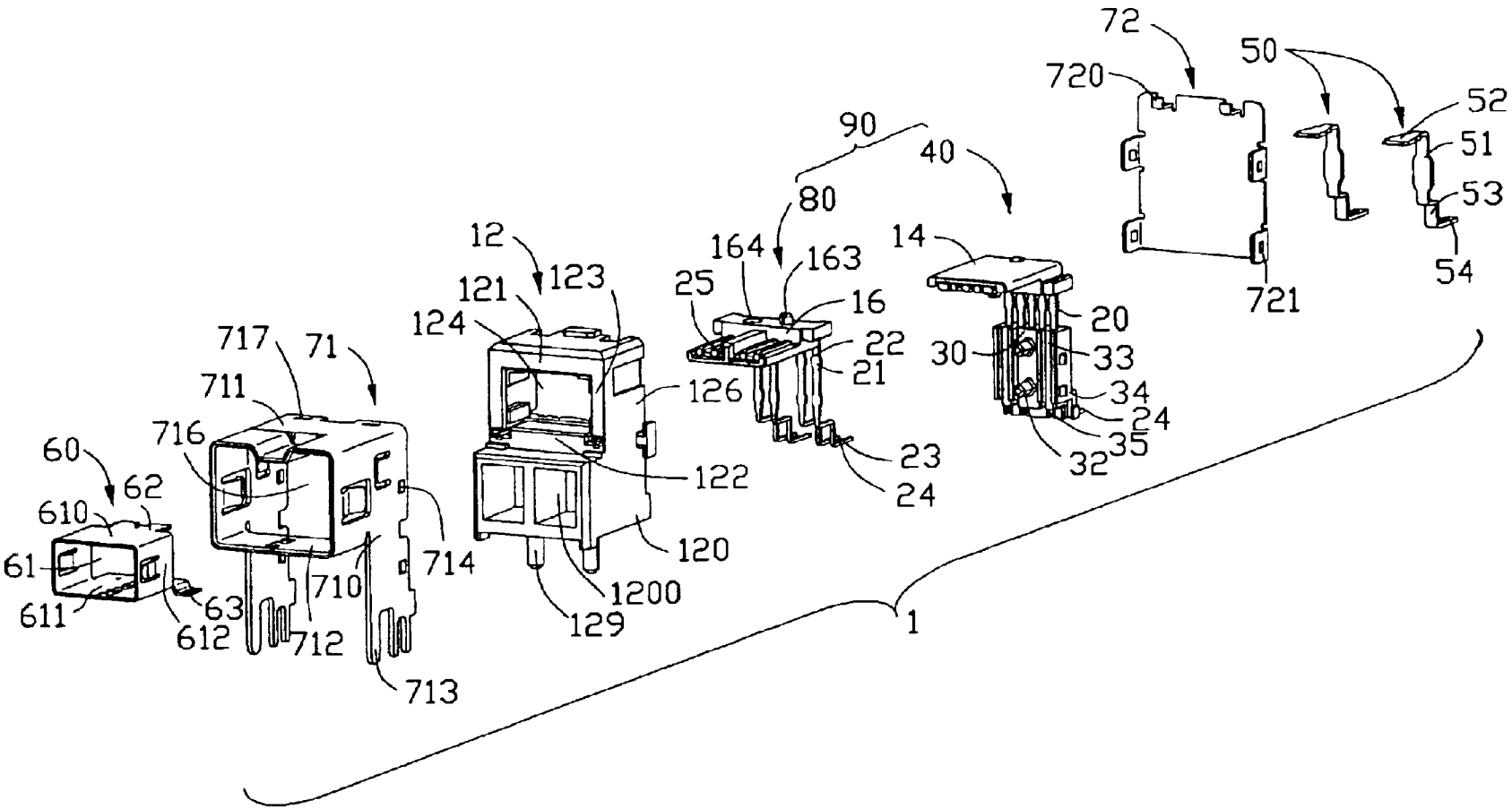
FIG. 1 is an exploded, perspective view of an electrical connector in accordance with the present invention.

Reference will now be made to the drawing figures to describe the present invention in detail.

Figure 2:
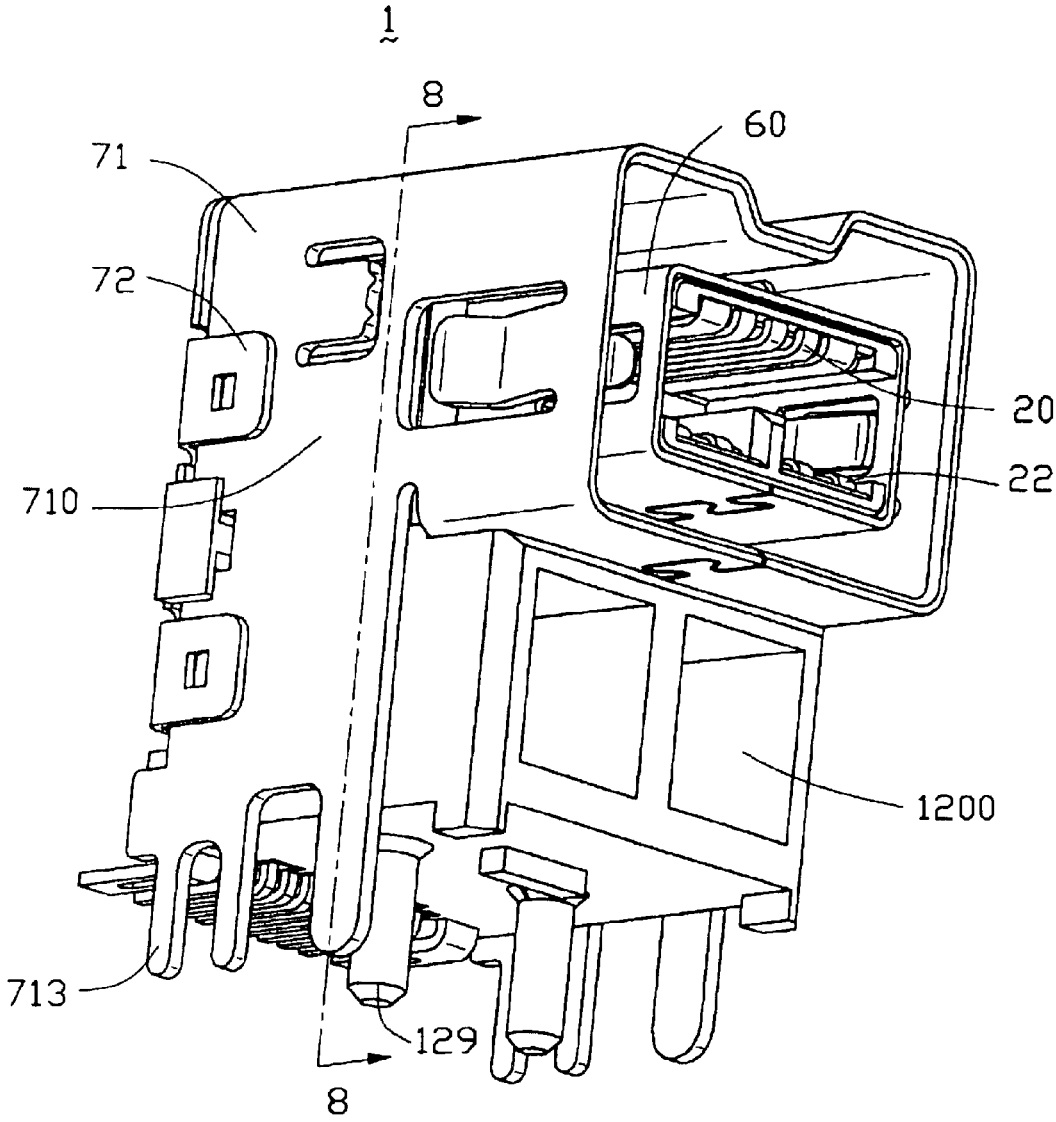
FIG. 2 is an assembled, perspective view of the electrical connector shown in FIG. 1.

With reference to FIGS. 1–2, an electrical connector 1 in accordance with the present invention and adapted for mounting on a printed circuit board (PCB, not shown) comprises an insulative housing 12, a terminal subassembly 90, an inner shell 60, an outer shell 71, a rear shell 72 and a pair of grounding tabs 50.

Figure 3:
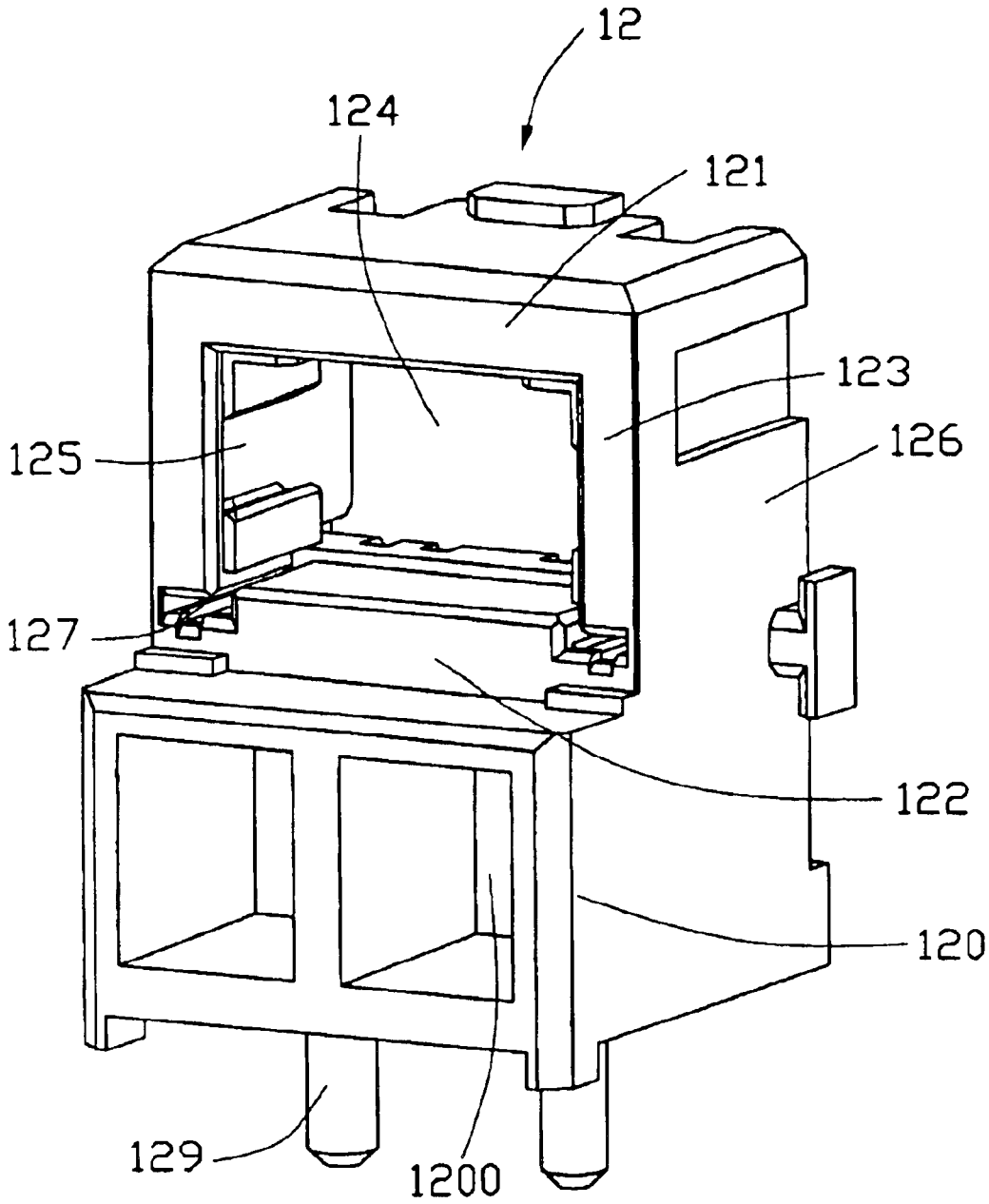
FIG. 3 is a front perspective view of an insulative housing of the electrical connector.

Referring to FIG. 3, the insulative housing 12 comprises a supporting portion 120 and a mating portion 126 above the supporting portion 120. The supporting portion 120 defines a pair of chambers 1200 extending rearwardly from a front face thereof for saving material and a plurality of posts 129 extending downwardly from a bottom face thereof for properly positioning the electrical connector 1 on the PCB. The mating portion 126 comprises opposite upper and lower walls 121, 122 and a pair of opposite side walls 123 interconnecting the upper and the lower walls 121, 122. The upper, the lower and the side walls 121, 122, 123 define a receiving space 124 therebetween. Each side wall 123 defines a groove 125 communicating with the receiving space 124 in an inner face thereof. The mating portion 126 defines a pair of channels 127 along opposite side edges of the lower wall 122 where the side walls 123 and the lower wall 122 are connected with each other.

Figure 4:
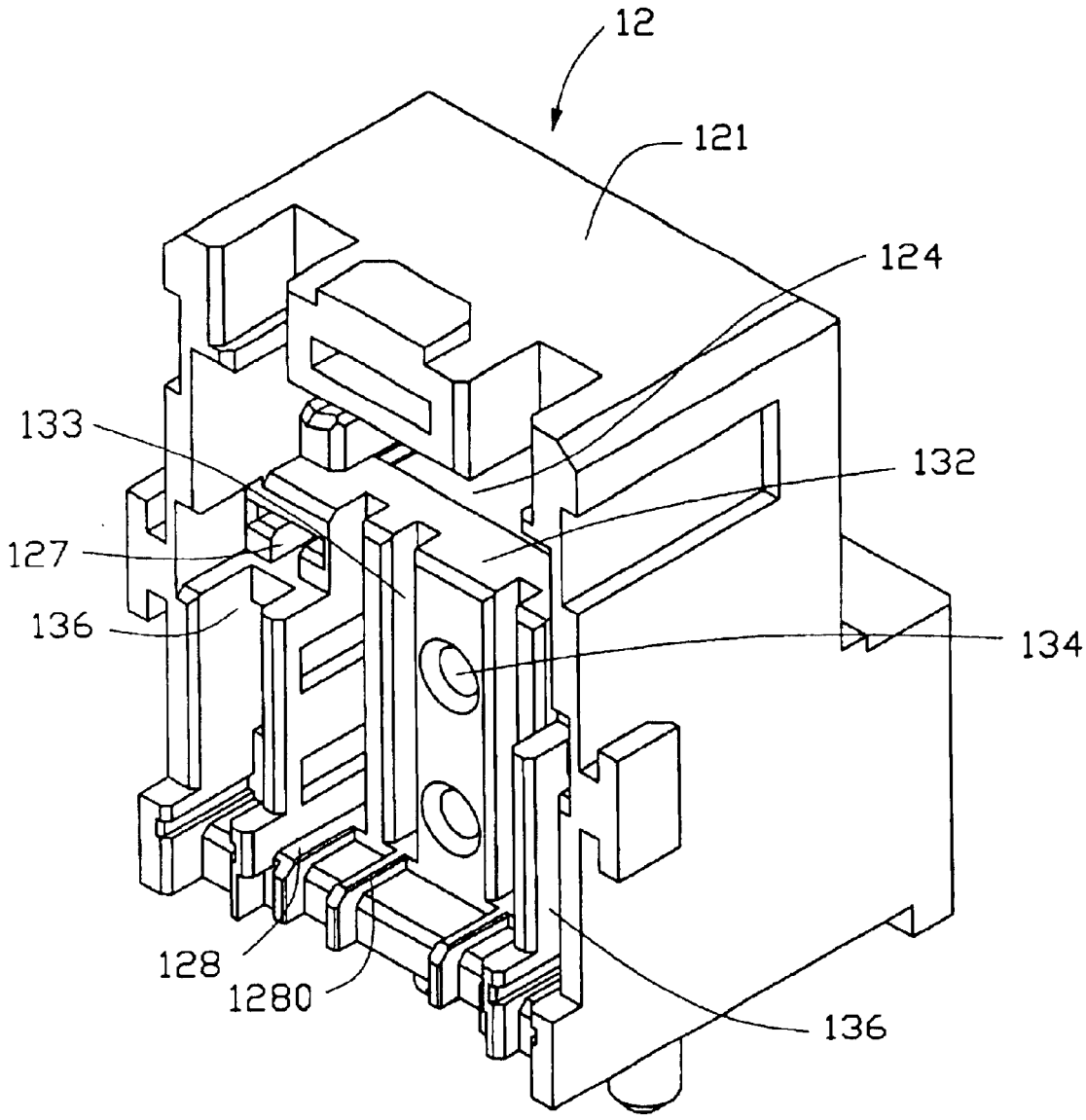
FIG. 4 is a rear perspective view of the insulative housing.

Referring to FIG. 4, the insulative housing 12 comprises a plurality of passageways 133 extending in a rear face thereof and communicating with the receiving space 124 respectively. A pair of retention holes 134 are provided between the passageways 133 and a pair of slots 136 are provided on opposite sides of the passageways 133. The insulative housing 12 is formed with a step portion 128 extending rearwardly from a lower end of the rear face thereof. A plurality of bulges 1280 are formed on the step portion 128 and aligning with corresponding passageways 133, respectively.

Figure 5:
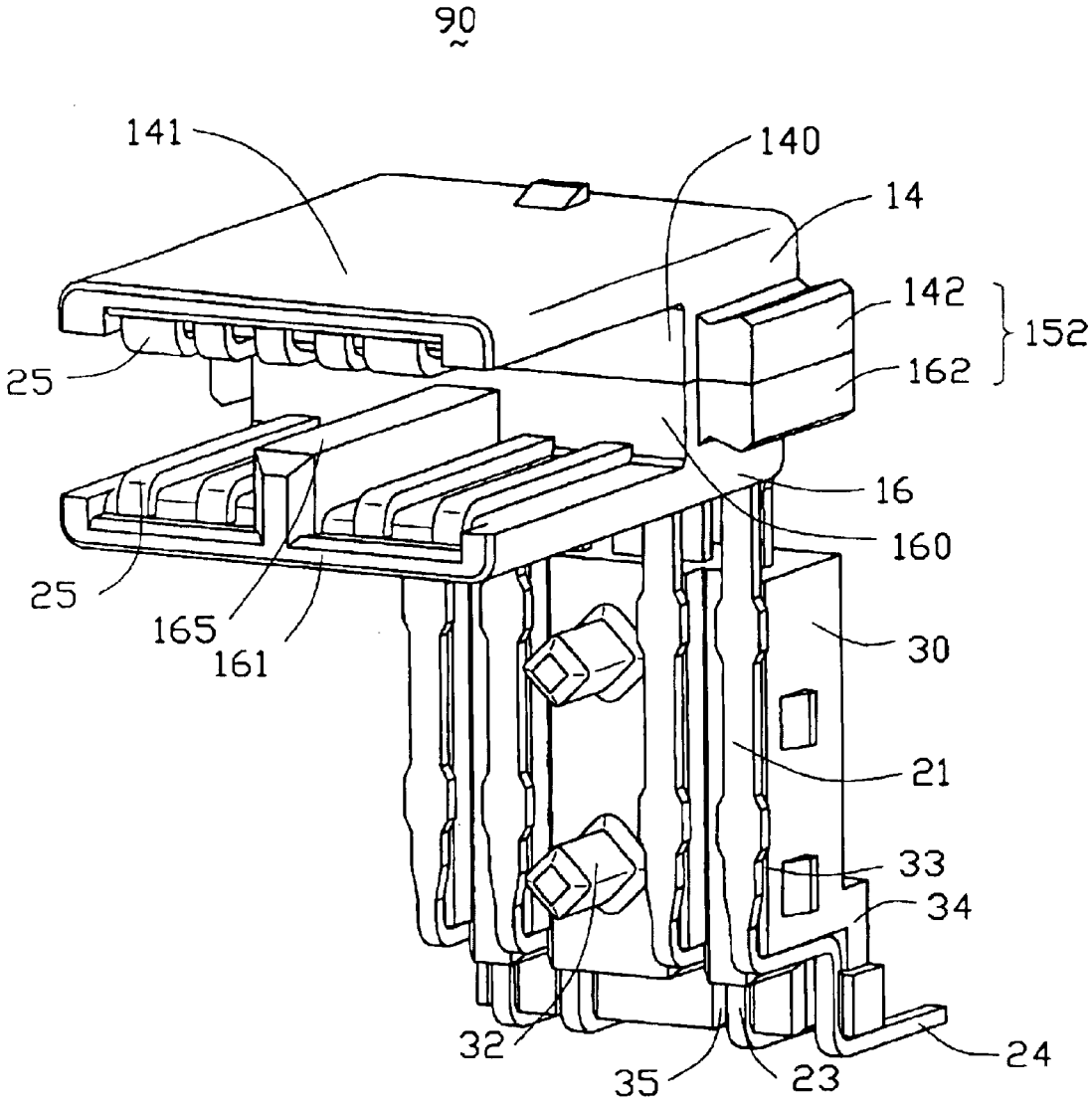
FIG. 5 is a perspective view of a terminal subassembly of the electrical connector.
Figure 6:
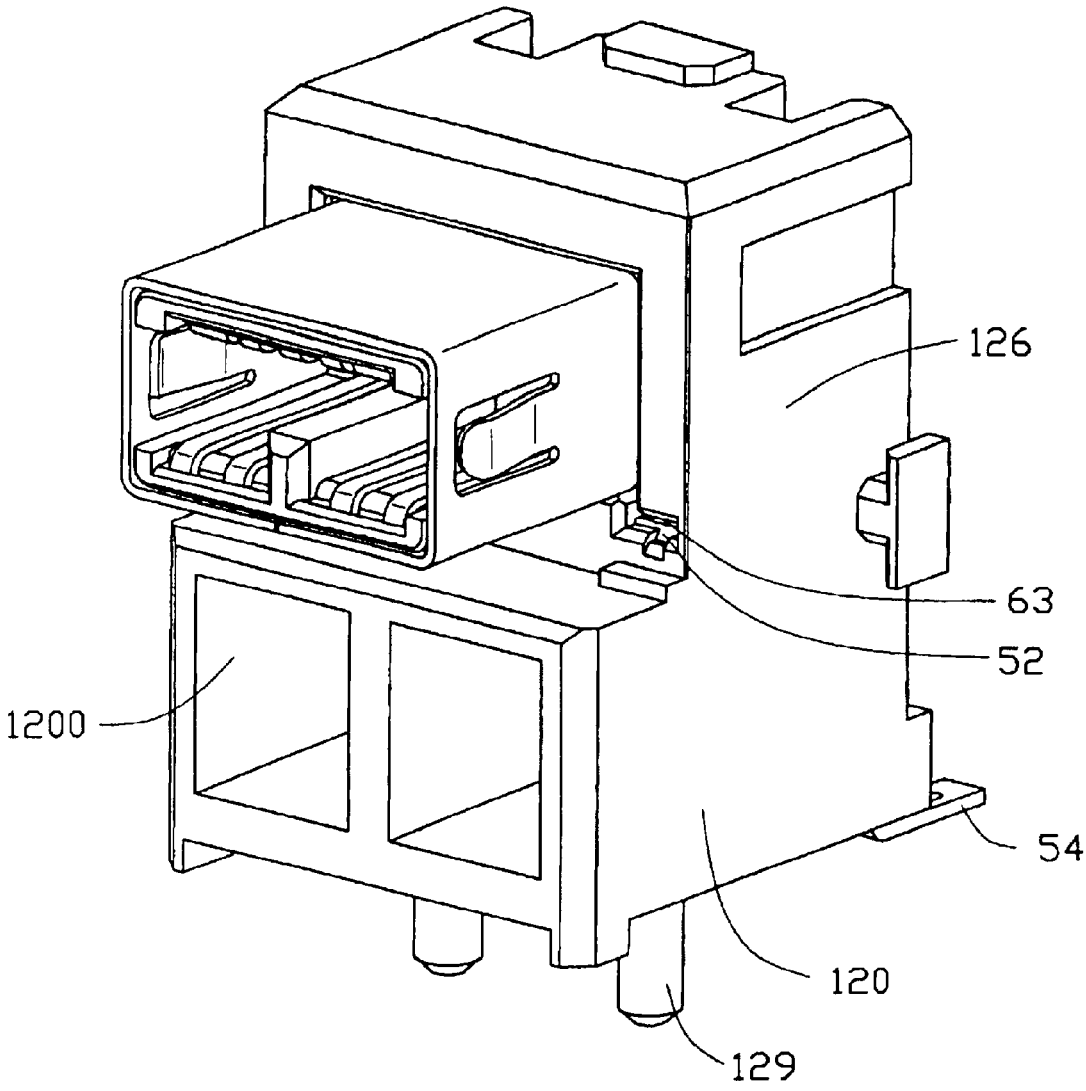
FIG. 6 is another perspective view of the electrical connector with an outer shell thereof being removed therefrom.
Figure 7:
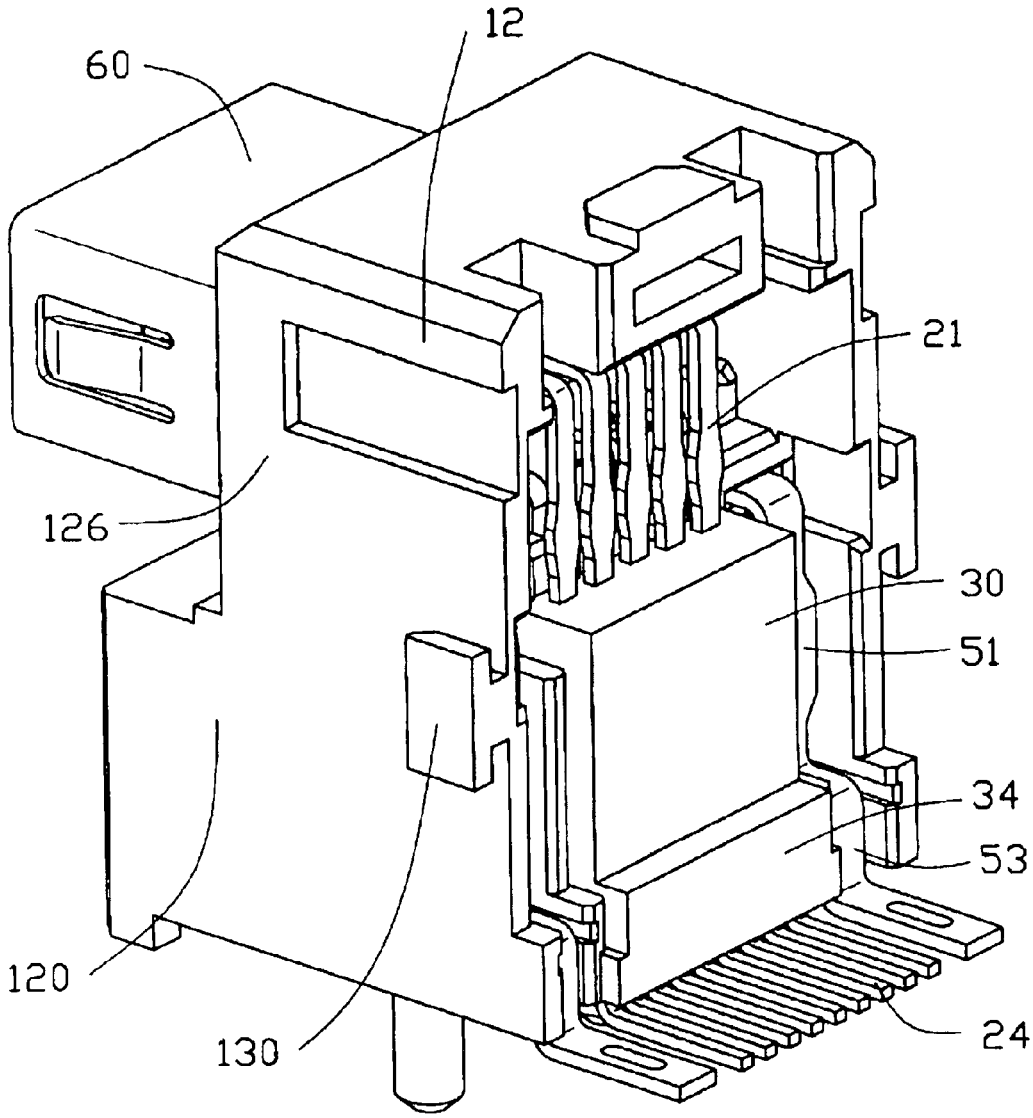
FIG. 7 is a view similar to FIG. 6 which taken from another aspect.

Turning to FIG. 5 in conjunction with FIG. 1, the terminal subassembly 90 includes a first terminal module 40 and a second terminal module 80 stackedly arranged with the first terminal module 40. The first terminal module 40 comprises a first dielectric body 14, a plurality of first terminals 20 retained in the first dielectric body 14, and a spacer 30. The second terminal module 80 comprises a second dielectric body 16 and a plurality of second terminals 22 retained in the second dielectric body 16.

Figure 8:
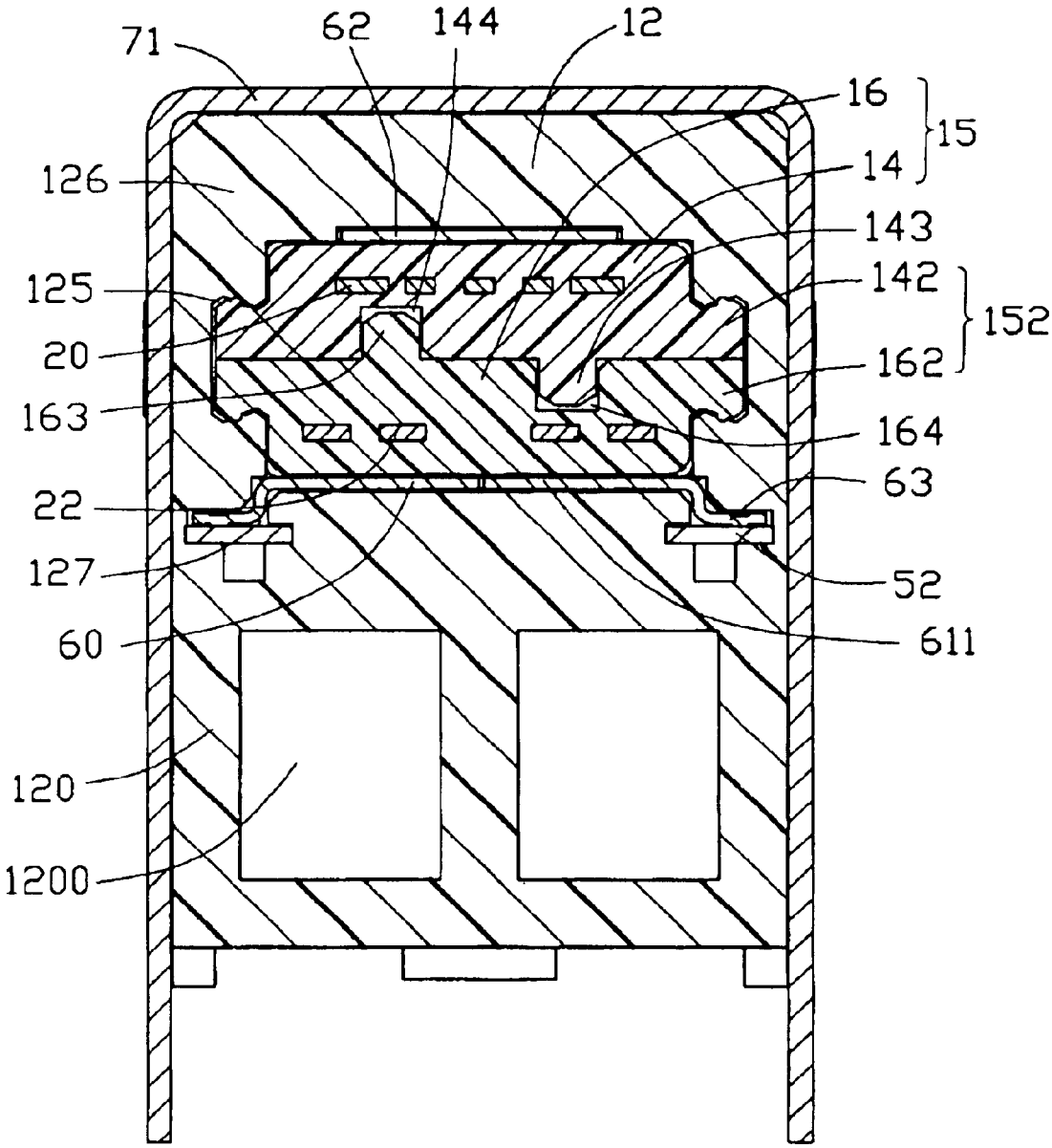
FIG. 8 is a cross-sectional view of the electrical connector taken along line 8—8 of FIG. 2.

Each of the first and the second dielectric bodies 14, 16 comprises a base portion 140, 160 having an engaging face for engaging with each other and a mating tongue 141, 161 extending forwardly a front face of the base portion 140. Each base portion 140 comprises a hole 144, 164 (FIG. 8) and a post 143, 163 formed on the engaging face. The hole 144 and the post 143 of the base portion 140 of the first dielectric body 14 are configured for matching with the corresponding post 163 and hole 164 of the base portion 160 of the second dielectric body 16 thereby holding the first and the second terminal modules 40, 80 at the proper position with respective to each other. A pair of opposite projections 142, 162 project laterally from opposite side faces of each base portion 140, 160. The projection 142 of the first dielectric body 14 and the corresponding projection 162 of the second dielectric body 16 together form a retaining portion 152 for being retained in the corresponding grooves 125 of the insulative housing 12 to thereby facilitating engagement between the terminal subassembly 90 and the housing 12. The mating tongues 141, 161 extend through the receiving space 124 of the mating portion 126. The mating tongue 161 of the second dielectric body 16 has a key 165 extending therefrom upwardly.

Each of the first and the second terminals 20, 22 comprises an vertically-extending intermediate portion 21, a contacting portion 25 extending forwardly from one end of the intermediate portion 21, an angled portion 23 extending from the other end of the intermediate portion 21 and a solder tail 24 extending from the angled portion 23 for soldering to corresponding pads of the printed circuit board. The first and the second terminals 20, 22 are insert-molded in the base 140, 160 and with the contacting portions 25 being disposed on opposite inner faces of the mating tongues 141, 161. The intermediate portions 21 of the first terminals 20 are partially retained in the spacer 30 with the angled portion 23 and the solder tails 24 extending outside the spacer 30.

The spacer 30 has a substantial rectangular cross section and has a step portion 34 formed for engaging with the step portion 128 of the insulative housing 12. A pair of retention posts 32 and a plurality of ribs 33 are formed on a front face of the spacer 30. The retention posts 32 of the spacer 30 are configured for being received in the corresponding retention holes 134 of the insulative housing 12. The intermediate portions 21 of the second terminals 22 abut against the corresponding ribs 33 of the spacer 30 and are received in the corresponding passageways 133 of insulative housing 12. The step portion 34 further defines a plurality of cutouts 35 aligned with the ribs 33 for receiving corresponding angled portion 23 of the second terminals 22 and then receiving bulges 1280 of the step portion 128 of the insulative housing 12.

Figure 9:
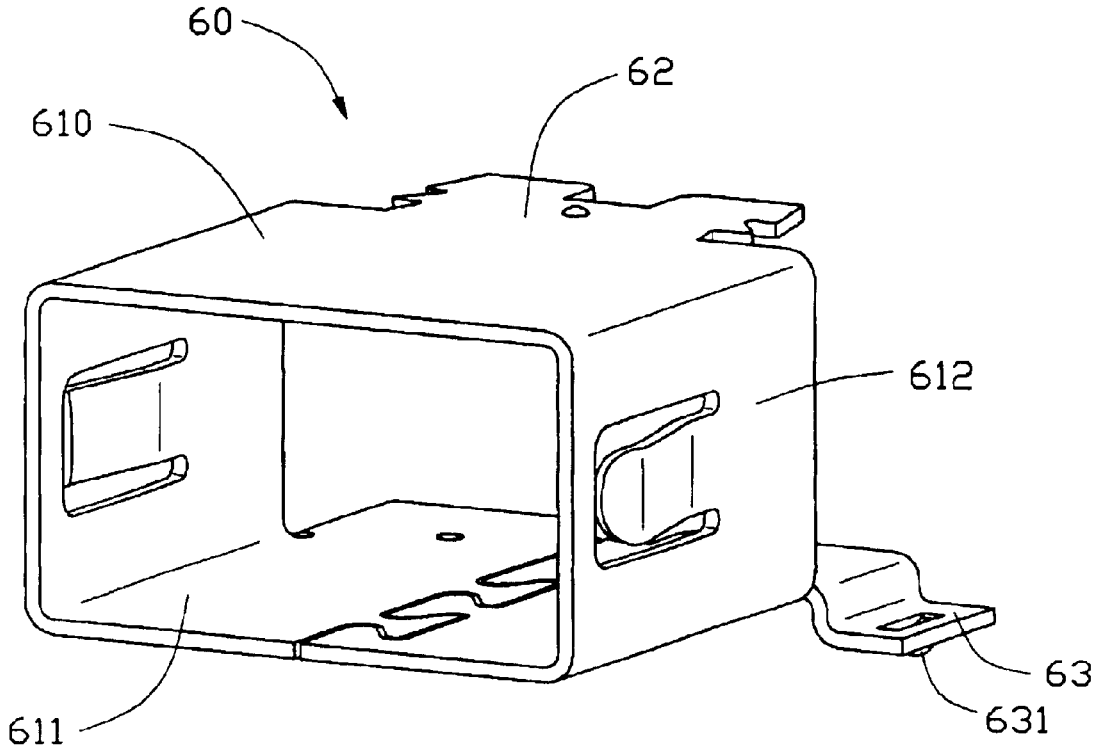
FIG. 9 is a perspective view of an inner shell of the electrical connector.

Together referring to FIG. 1 and FIG. 9, the inner shell 60 and the outer shell 71 are stamped from a piece of metal sheet, respectively. The inner shell 60 encloses the tongues 141, 161 of the first and the second dielectric bodies 14, 16 and comprises an upper wall 610, a lower wall 611, and two opposite side walls 612 extending between the upper and lower wall 610, 611. A retaining tab 62 extended rearwardly and laterally from a rear edge of the upper wall 610, and a pair of grounding legs 63 extend oppositely from the lower wall 611 which are received in the corresponding channels of the insulative housing 12. Each grounding leg 63 has a projection 631 protruded downwardly therefrom.

The outer shell 71 is attached to the insulative housing 12 and defines a receiving opening 716 for further accommodating the inner shell 60. Similarly, the outer shell 71 comprises a top wall 711, a bottom wall, and a pair of side walls 710 connecting the top and bottom wall 711, 712. Each side wall 710 has a downwardly-extending retaining member 713 for electrically connecting with the grounding circuit on the PCB.

The rear shell 72 covers the rear face of the insulative housing 12 and is formed with a plurality of tabs 720 for engaging with openings 717 defined in the top wall 711 of the outer shell 71. A plurality of the tabs 721 are provided on opposite edges of the rear shell 72 for engaging with corresponding notches 714 opened in the side walls 710 of the outer shell 71.

Continuing to FIG. 1, each grounding tab 50 comprises a vertical intermediate portion 51 received in corresponding slot 136 of the insulative housing 12, a contacting portion 52 extending forwardly from one end of the intermediate portion 51, an angled portion 53 extending from the other end of the intermediate portion 51 and a solder tail 54 extending horizontally from the angled portion 53 for electrically connecting with the grounding path of the PCB. The contacting portion 52 of each grounding tab 50 is received in corresponding channel 127 of the insulative housing 12 and contacts with the projection 631 of the grounding legs 63 of the inner shell 60.

In assembly, the terminal module 90 is inserted into the mating portion 126 of the insulative housing 12 from the rear face of the insulative housing. The inner shell 60 is assembled to the mating portion 126 from the front face of isolative housing 12, the grounding legs 63 of the inner shell 60 are received in the channels 127 of the insulative housing 12. The outer shell 71 encloses the insulative housing 12 and the rear shell 72 cover the rear face of the insulative housing 12. The contacting portion 52 of the grounding tabs 51 are held in the channels 127 and electrically connect to said grounding legs 63 of the inner shell 60.

Figure 10:
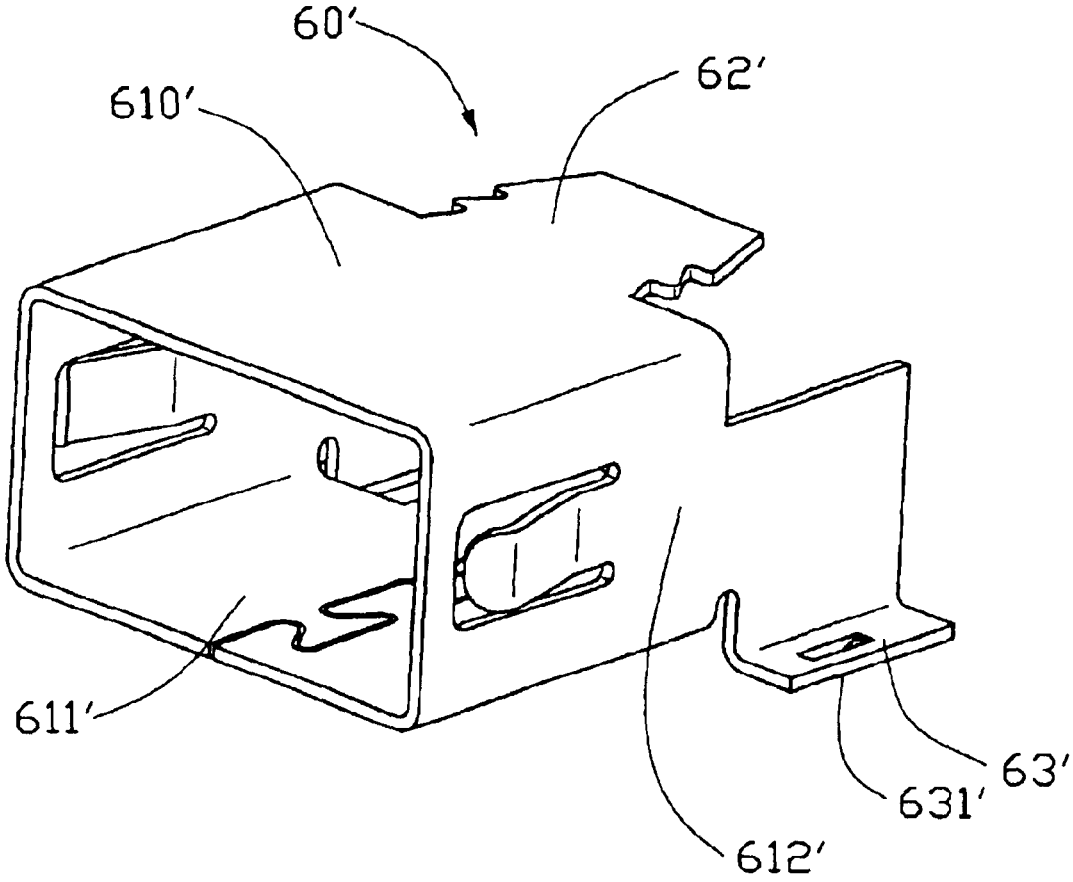
FIG. 10 is a perspective view of an inner shell in accordance with a second embodiment of the present invention.

Referring to the FIG. 10, an inner shell 60 in accordance with a second embodiment of the present invention is shown. Particularly, the grounding legs 63' of the inner shell 60' extend horizontally and laterally from bottom edges of the two opposed side walls 612', respectively. Similarly, each grounding leg 63' comprises a projection 631' protruded therefrom for electrically contacting with the contacting portion 52 of the grounding tabs 50.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulative housing comprising a supporting portion, a mating portion above the supporting portion, and a channel defined in the mating portion;

an inner shell disposed in the mating portion and comprising a grounding leg extending into the channel;

an outer shell enclosing both the insulative housing and the inner shell;

a plurality of terminals extending through the mating portion and being enclosed by the inner shell; and a grounding tab comprising an intermediate portion, a contacting portion extending from the intermediate portion, and a solder tail opposite to the contacting portion, the contacting portion extending into the said channel and parallelly electrically connecting to the grounding leg of the inner shell.

2. The electrical connector as described in claim 1, wherein the grounding leg comprises a protruded therefrom.

3. The electrical connector as described in claim 1, wherein the insulative housing defines a slot to receive the intermediate portion of the grounding tab.

4. The electrical connector as described in claim 1, wherein the grounding tab comprises an angled portion between the intermediate portion and the solder tail.

5. The electrical connector as described in claim 1, further comprising a rear shell covering a rear face of the insulative housing and engaging with the outer shell.

6. The electrical connector as described in claim 1, further comprising a second grounding tab, wherein the mating portion defines a second channel receiving the second grounding tab and wherein the inner shell comprises a second grounding leg extending into the second channel and electrically connecting with the second grounding tab.

7. The electrical connector as described in claim 1, wherein the mating portion of the insulative housing comprises a upper wall, a lower wall and a pair of opposite side walls connecting the upper wall and the lower wall, the upper wall, the bottom wall and the side walls defining a receiving space thereberween.

8. The electrical connector as described in claim 7, wherein the channel is defined in the lower wall of the insulative housing and communicates with the receiving space.

9. The electrical connector as described in claim 1, wherein the inner shell comprises an upper wall, a lower wall and a pair of side walls connecting the upper wall and the lower wall.

10. The electrical connector as described in claim 9, wherein the grounding leg extends rearwardly from of the lower wall.

11. The electrical connector as described in claim 9, wherein the grounding leg extends from one of the two opposed side wall.

12. The electrical connector as described in claim 1, further comprises a first terminal module and a second terminal module stackedly arranged with the first terminal module, the first and the second modules being retained in the receiving space of the insulative housing and comprising a first dielectric bodies insert-molded with first terminals and a second dielectric bodies insert-molded with second terminals.

13. The electrical connector as described in claim 12, wherein the first terminal module comprises a spacer insert-molded with the first terminals and assembled to the insulative housing.

14. The electrical connector as described in claim 12, wherein a key extends upwardly from the second dielectric body toward the first dielectric body.

15. An electrical connector comprising:

an insulative housing including a mating portion with a receiving space for receiving complementary connector therein, and a pair of horizontal channels communicatively located on two sides of the receiving space;

a metallic inner shell received in the receiving space with a pair of horizontal grounding legs extending into the corresponding channels;

a plurality of terminals disposed in the housing and further extending into the inner shell;

a metallic outer shell enclosing said housing; and a pair of grounding tabs inserted into the housing from a rear face of the housing and laterally located between said inner shell and said outer shell; wherein each of said grounding tabs includes a horizontal contacting portion mechanically and electrically engaged with a corresponding grounding leg in the channel.

16. The connector as described in claim 15, wherein said pair of channels are located below said receiving space.

* * * * *